US011802388B1

(12) United States Patent
Belnavis

(10) Patent No.: US 11,802,388 B1
(45) Date of Patent: Oct. 31, 2023

(54) SNOW PLOW SHOVEL

(71) Applicant: Kevin Belnavis, Highland Park, NJ (US)

(72) Inventor: Kevin Belnavis, Highland Park, NJ (US)

( * ) Notice: Subject to any disclaimer, the term of this patent is extended or adjusted under 35 U.S.C. 154(b) by 375 days.

(21) Appl. No.: 17/202,728

(22) Filed: Mar. 16, 2021

(51) Int. Cl.
*E01H 5/06* (2006.01)
*E01H 5/02* (2006.01)

(52) U.S. Cl.
CPC ..... *E01H 5/02* (2013.01); *E01H 5/061* (2013.01)

(58) Field of Classification Search
CPC ..... E01H 5/02; E01H 5/061; E01H 5/062
USPC ..... 37/265, 278, 284, 285
See application file for complete search history.

(56) References Cited

U.S. PATENT DOCUMENTS 1,041,605 A * 10/1912 Deininger ..... F25C 5/043 37/285
1,049,812 A * 1/1913 Darling ..... E01H 5/02 294/51
1,307,410 A * 6/1919 Morris ..... E01H 5/06 172/736
1,820,692 A * 8/1931 Cooper ..... E01H 5/02 37/274
2,432,780 A * 12/1947 Mader ..... E01H 5/02 37/283
2,460,560 A * 2/1949 Williams ..... E01H 5/02 280/47.24
2,590,143 A * 3/1952 Adams, Jr. ..... E01H 5/065 37/278
2,811,792 A * 11/1957 Cork, Jr. ..... E01H 5/02 37/270
3,431,661 A * 3/1969 Carlson ..... E01H 5/02 37/278
3,526,979 A * 9/1970 Ladewski ..... E01H 5/06 37/278
3,994,081 A * 11/1976 Middleton ..... E01H 5/04 37/283
4,034,489 A * 7/1977 Hughes, Jr. ..... E01H 5/10 219/201
4,796,367 A * 1/1989 Kulat ..... E01H 5/02 37/278
5,511,328 A * 4/1996 Fingerer ..... E01H 5/02 37/285
5,676,412 A * 10/1997 Kahley ..... E01H 5/02 294/54.5
5,791,072 A * 8/1998 Schbot ..... E01H 5/02 403/96
5,816,634 A * 10/1998 Jacobs ..... A01B 1/02 294/57
5,957,516 A * 9/1999 Jacobs ..... E01H 5/02 294/57

(Continued)

*Primary Examiner* — Gary S Hartmann
(74) *Attorney, Agent, or Firm* — Kyle A. Fletcher, Esq.

(57) ABSTRACT

The snow plow shovel comprises a blade, a collar, and a handle. The snow plow shovel may be a shovel for removing a wintry accumulation from a surface. As non-limiting examples, the wintry accumulation may be snow or ice and the surface may be a sidewalk or a driveway. The blade is further defined with a first panel and a second panel. The first panel and the second panel may shape the blade to form a V-plow. The V-plow may be operable to push the wintry accumulation off of the surface by placing a leading edge of the blade against the surface and pushing the blade forward.

16 Claims, 3 Drawing Sheets

(56) References Cited

U.S. PATENT DOCUMENTS

| | | | | |
|---|---|---|---|---|
| 6,269,558 | B1 * | 8/2001 | Alexander | E01H 5/02 37/278 |
| 7,293,361 | B1 * | 11/2007 | Miller | F25C 5/043 173/90 |
| 9,206,569 | B1 * | 12/2015 | Roy | E01H 5/02 |
| D783,685 | S * | 4/2017 | Gruber | D15/11 |
| 9,868,202 | B1 * | 1/2018 | Burcham | B25G 3/36 |
| 9,969,074 | B2 * | 5/2018 | Flaherty | B25G 1/01 |
| 10,492,352 | B1 * | 12/2019 | Sheth | A01B 1/20 |
| 2007/0028487 | A1 * | 2/2007 | Larson | E01H 5/02 37/278 |
| 2009/0013564 | A1 * | 1/2009 | Mallaridas | E01H 5/02 37/270 |
| 2011/0214316 | A1 * | 9/2011 | Gomez | E01H 5/02 37/284 |
| 2017/0218584 | A1 * | 8/2017 | Iqbal | E01H 5/061 |

* cited by examiner

SNOW PLOW SHOVEL

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the fields of shovels and snow removal equipment, more specifically, a snow plow shovel.

SUMMARY OF INVENTION

The snow plow shovel comprises a blade, a collar, and a handle. The snow plow shovel may be a shovel for removing a wintry accumulation from a surface. As non-limiting examples, the wintry accumulation may be snow or ice and the surface may be a sidewalk or a driveway. The first panel and the second panel may shape the blade to form a V-plow. The V-plow may be operable to push the wintry accumulation off of the surface by placing a leading edge of the blade against the surface and pushing the blade forward.

An object of the invention is to provide a shovel with a blade comprising a first panel and a second panel that are hinged at a 45 degree angle.

Yet another object of the invention is to provide a second orientation of the first panel and the second panel to form a V-plow.

These together with additional objects, features and advantages of the snow plow shovel will be readily apparent to those of ordinary skill in the art upon reading the following detailed description of the presently preferred, but nonetheless illustrative, embodiments when taken in conjunction with the accompanying drawings.

In this respect, before explaining the current embodiments of the snow plow shovel in detail, it is to be understood that the snow plow shovel is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the snow plow shovel.

It is therefore important that the claims be regarded as including such equivalent construction insofar as they do not depart from the spirit and scope of the snow plow shovel. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
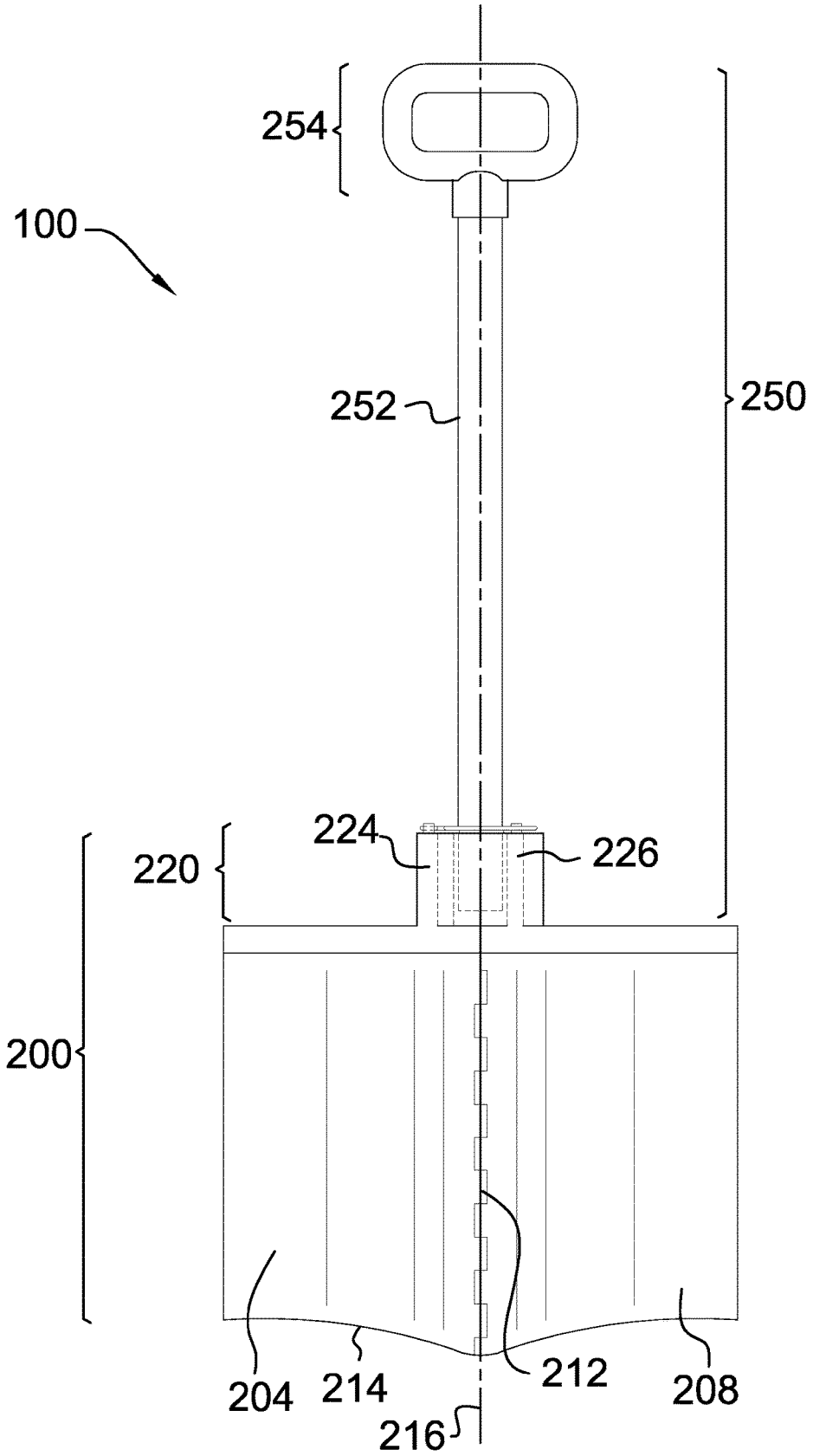
FIG. 1 is a front view of an embodiment of the disclosure.
Figure 2:
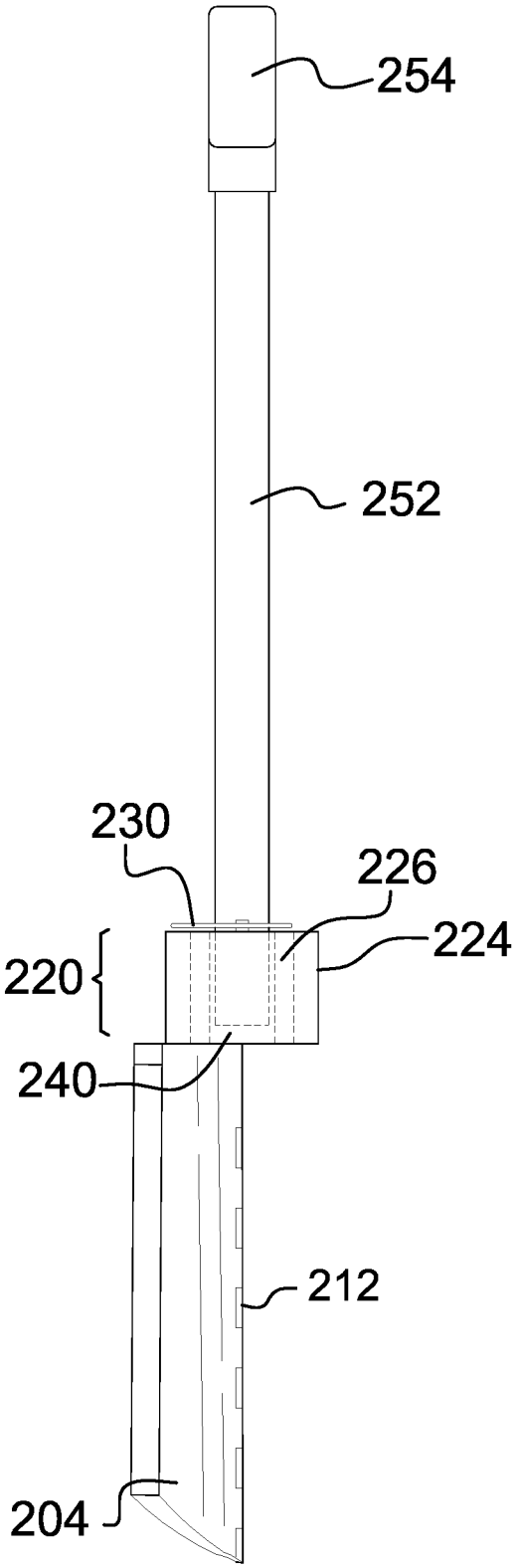
FIG. 2 is a side view of an embodiment of the disclosure.
Figure 3:
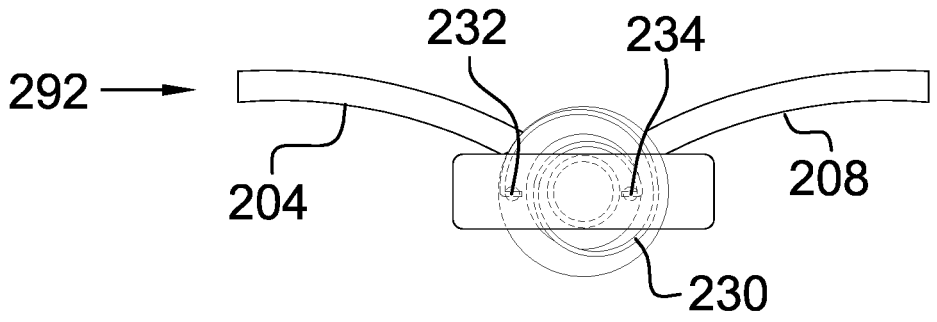
FIG. 3 is a top view of an embodiment of the disclosure.
Figure 4:
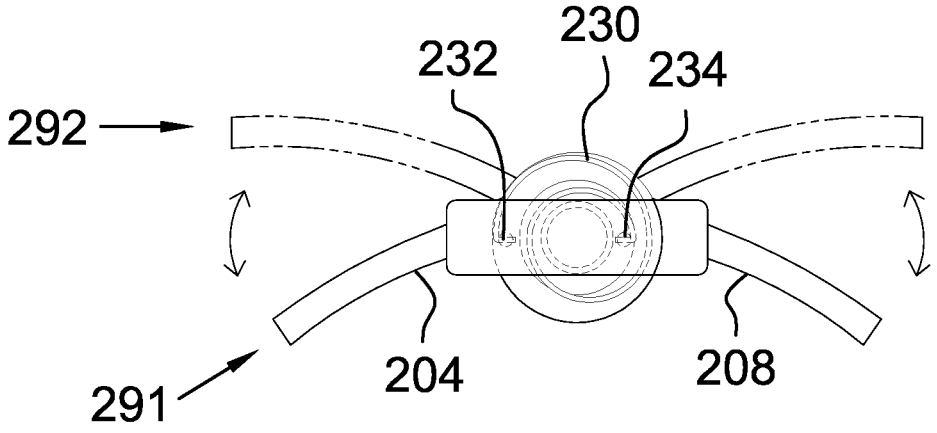
FIG. 4 is an in-use view of an embodiment of the disclosure illustrating the blade moving between the first orientation and the second orientation.

Detailed reference will now be made to a first potential embodiment of the disclosure, which is illustrated in FIGS. 1 through 4.

The snow plow shovel 100 (hereinafter invention) comprises a blade 200, a collar 220, and a handle 250. The invention 100 may be a shovel for removing a wintry accumulation from a surface. As non-limiting examples, the wintry accumulation may be snow or ice and the surface may be a sidewalk or a driveway. The blade 200 may be further defined with a first panel 204 and a second panel 208. In a first orientation 291, the first panel 204 and the second panel 208 may shape the blade 200. In a second orientation 292, the first panel 204 and the second panel 208 may shape the blade 200 to form a V-plow at a 45 degree angle. The V-plow may be operable to push the wintry accumulation off of the surface by placing a leading edge 214 of the blade 200 against the surface and pushing the blade 200 forward.

The blade 200 may comprise the first panel 204, the second panel 208, and a hinge 212. The blade 200 may be the portion of the shovel which contacts the wintry accumulation and the surface and which moves the wintry accumulation to both sides. The first panel 204 may be pivotably coupled to the second panel 208 by the hinge 212 along a centerline 216. Both the first panel 204 and the second panel 208 may be concave with respect to the front of the blade 200. The first panel 204 and the second panel 208 may be mirror images of each other.

In the first orientation 291, the first panel 204 and the second panel 208 may align at the hinge 212 to form a single concave surface extending from one side of the blade 200 to the opposite side of the blade 200. In the second orientation 292, the first panel 204 and the second panel 208 may couple angularly at the hinge 212 to form two adjacent concave surfaces that may be coupled at the centerline 216 of the blade 200.

The leading edge 214 of both the first panel 204 and the second panel 208 may be concave such that the leading edge 214 of the blade 200 may rest on the surface when the blade 200 is in the second orientation 292.

The collar 220 may comprise concentric sleeves and a spring 230. The collar 220 may be a moveable interface between the blade 200 and the handle 250. The concentric sleeves may be concentric hollow cylinders that may rotate around a common central axis. The concentric sleeves may comprise an outer sleeve 224 and an inner sleeve 226. The outer sleeve 224 may be coupled to the top of the first panel 204. The inner sleeve 226 may be coupled to the top of the second panel 208.

The spring 230 located at the top of the collar 220 may bias the first panel 204 and the second panel 208 to move to the second orientation 292. As a non-limiting example, the spring 230 may be a spiral torsion spring. A first spring keeper 232 may couple one end of the spring 230 to the outer sleeve 224. A second spring keeper 234 may couple the opposite end of the spring 230 to the inner sleeve 226.

A shaft 252 of the handle 250 may couple to the collar 220 at a well 240 formed at the center of the collar 220.

The handle 250 may comprise the shaft 252 and a handgrip 254. The handle 250 may be adapted for a user to hold in order to operate the shovel. Typically, the user may grasp a midpoint of the handle 250 with one hand and the handgrip 254 with the other hand.

The shaft 252 may be a cylindrical rod extending vertically from the collar 220 to the handgrip 254. The handgrip 254 may be a D-shaped armature adapted to be held by the user.

In use, the user may move the first panel 204 and the second panel 208 into the second orientation 292 to use a V-plow. In the second orientation 292, the user may place the leading edge 214 of the blade 200 against the surface and may push the shovel forward to plow the wintry accumulation from the surface. As the blade 200 is forced forward, the blade 200 may shove the wintry accumulation to the right using the first panel 204 and to the left using the second panel 208.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" may refer to top and "lower" may refer to the bottom. As a non-limiting example, the upper end of a vertical shaft is the top end of the vertical shaft.

As used herein, "align" may refer to the placement of two or more components into positions and orientations which either arranges the components along a straight line or within the same plane or which will allow the next step of assembly to proceed. As a non-limiting example, the next step of assembly may be to insert one component into another component, requiring alignment of the components.

As used in this disclosure, the "centerline" may be an imaginary line that defines the center of one or more cross sections of an object. Unless stated otherwise, the centerline follows a longitudinal path through the object at the center of lateral cross sections. If the object is tubular, the centerline follows the center of the tube.

As used in this disclosure, "concave" may be used to describe a surface that resembles the interior surface of a sphere or a portion thereof.

As used herein, the words "couple", "couples", "coupled" or "coupling", may refer to connecting, either directly or indirectly, and does not necessarily imply a mechanical connection.

As used in this disclosure, a "cylinder" may be a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder which is defined as a cylinder wherein the curved surface perpendicularly intersects with the two identical flat and parallel ends.

As used herein, "front" may indicate the side of an object that is closest to a forward direction of travel under normal use of the object or the side or part of an object that normally presents itself to view or that is normally used first. "Rear" or "back" may refer to the side that is opposite the front.

As used herein, "handle" may refer to an object by which a tool, object, or door is held or manipulated with the hand.

As used in this disclosure, a "hinge" may be a device that permits the turning, rotating, or pivoting of a first object relative to a second object.

As used here, the word "midpoint" may refer to a point that is between the ends of an object. An "exact midpoint" may refer to a midpoint that is equidistant from edges of the object in at least one direction. Unless otherwise stated, a midpoint is not required to be at the exact center of the object but instead may be within 50% of the distance from the exact midpoint to the farthest edge, farthest end, or farthest corner.

As used in this disclosure, "orientation" may refer to the positioning and/or angular alignment of a first object relative to a second object or relative to a reference position or reference direction.

As used in this disclosure, the term "shaft" may be used to describe a rigid cylinder. A shaft is often used as the handle of a tool or implement or as the center of rotating machinery or motors. The definition of shaft explicitly includes solid shafts or shafts that comprise a hollow passage through the shaft along the center axis of the shaft cylinder, whether the shaft has one or more sealed ends or not.

As used in this disclosure, a "spiral" describes a locus of points within a plane moving around a fixed center wherein the locus of points moves monotonically increasing manner away from the center.

As used in this disclosure, a "spring" may be a device that is used to store mechanical energy. This mechanical energy will often be stored by deforming an elastomeric material that is used to make the device, by recoil when the application of a torque to a rigid structure, or by a combination thereof. In some embodiments, the rigid structure to which torque is applied may be composed of ice, cement, or asphalt.

As used in this disclosure, a "torsion spring" may be a mechanical device that stores mechanical energy through an opposing torque when the mechanical device is twisted. The torsion spring will return to its original relaxed shape when the obstacle is removed.

As used in this disclosure, "vertical" may refer to a direction that is parallel to the local force of gravity. Unless specifically noted in this disclosure, the vertical direction is always perpendicular to horizontal.

With respect to the above description, it is to be realized that the optimum dimensional relationship for the various components of the invention described above and in FIGS. 1 through 4, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A snow plow shovel comprising:

a blade, a collar, and a handle;

wherein the snow plow shovel is a shovel for removing a wintry accumulation from a surface;

wherein the blade is further defined with a first panel and a second panel;

wherein the first panel and the second panel shape the blade to form a V-plow;

wherein the V-plow is operable to push the wintry accumulation off of the surface by placing a leading edge of the blade against the surface and pushing the blade forward;

wherein the collar comprises concentric sleeves and a spring;

wherein the collar is a moveable interface between the blade and the handle;

wherein the concentric sleeves comprise an outer sleeve and an inner sleeve;

wherein the outer sleeve is coupled to the top of the first panel;

wherein the inner sleeve is coupled to the top of the second panel.

2. The snow plow shovel according to claim 1 wherein the blade comprises the first panel, the second panel, and a hinge;

wherein the blade is the portion of the shovel which contacts the wintry accumulation and the surface and which moves the wintry accumulation.

3. The snow plow shovel according to claim 2 wherein the first panel is pivotably coupled to the second panel by the hinge along a centerline.

4. The snow plow shovel according to claim 3 wherein both the first panel and the second panel are concave with respect to the front of the blade.

5. The snow plow shovel according to claim 4 wherein the first panel and the second panel are mirror images of each other.

6. The snow plow shovel according to claim 5 wherein the first panel and the second panel align at the hinge to form a single concave surface extending from one side of the blade to the opposite side of the blade.

7. The snow plow shovel according to claim 6 wherein the first panel and the second panel couple angularly at the hinge to form two adjacent concave surfaces that are coupled at the centerline of the blade.

8. The snow plow shovel according to claim 7 wherein the leading edge of both the first panel and the second panel are concave such that the leading edge of the blade rests on the surface.

9. The snow plow shovel according to claim 8 wherein the concentric sleeves are concentric hollow cylinders that rotate around a common central axis.

10. The snow plow shovel according to claim 9 wherein the spring located at the top of the collar biases the first panel and the second panel.

11. The snow plow shovel according to claim 10 wherein the spring is a spiral torsion spring.

12. The snow plow shovel according to claim 10 wherein a first spring keeper couples one end of the spring to the outer sleeve;

wherein a second spring keeper couples the opposite end of the spring to the inner sleeve.

13. The snow plow shovel according to claim 12 wherein a shaft of the handle couples to the collar at a well formed at the center of the collar.

14. The snow plow shovel according to claim 13 wherein the handle comprises the shaft and a handgrip;

wherein the handle is adapted for a user to hold in order to operate the shovel.

15. The snow plow shovel according to claim 14 wherein the shaft is a cylindrical rod extending vertically from the collar to the handgrip.

16. The snow plow shovel according to claim 15 wherein the handgrip is a D-shaped armature adapted to be held by the user.

* * * * *